US005713574A

United States Patent [19]

Hughes

[11] Patent Number: 5,713,574

[45] Date of Patent: Feb. 3, 1998

[54] CARD GAME METHOD

[76] Inventor: Alan Hughes, 5 Wembley Hill Road, Wembley, Middlesex, England, HA9 8AF

[21] Appl. No.: 789,021

[22] Filed: Jan. 27, 1997

Related U.S. Application Data

[63] Continuation-in-part of Ser. No. 621,837, Mar. 26, 1996, abandoned.

[51] Int. Cl.[6] ..... A63F 1/00

[52] U.S. Cl. ..... 273/292

[58] Field of Search ..... 273/292, 293, 273/303, 274

[56] References Cited

U.S. PATENT DOCUMENTS

| | | | |
|---|---|---|---|
| 4,440,398 | 4/1984 | Charon . | |
| 4,659,087 | 4/1987 | Shen et al. . | |
| 5,224,706 | 7/1993 | Bridgeman et al. | 273/292 X |
| 5,288,081 | 2/1994 | Breeding . | |
| 5,288,082 | 2/1994 | Marquez | 273/292 |
| 5,294,128 | 3/1994 | Marquez . | |
| 5,314,193 | 5/1994 | Ferrer . | |
| 5,322,295 | 6/1994 | Cabot et al. | 273/292 |
| 5,364,105 | 11/1994 | Jones | 273/292 |
| 5,366,228 | 11/1994 | Kangsanaraks . | |
| 5,377,973 | 1/1995 | Jones et al. | 273/292 X |
| 5,377,993 | 1/1995 | Josephs | 273/292 X |
| 5,382,025 | 1/1995 | Sklansky et al. . | |
| 5,411,268 | 5/1995 | Nelson et al. . | |
| 5,415,414 | 5/1995 | Savage . | |

*Primary Examiner*—William E. Stoll
*Attorney, Agent, or Firm*—Cahn & Samuels, LLP

[57] ABSTRACT

A method of playing a casino style type card game adapted for wagering by multiple players playing against a dealer. The game uses a standard fifty-two card deck and combines attributes of poker and Blackjack. Winning hands are determined according to conventional poker ranking rules by each player comparing a three card hand derived from four cards dealt in a specific sequence against that of the dealer. The game also optionally includes doubling, surrendering, awarding bonuses, insurance, and a progressive jackpot.

31 Claims, 3 Drawing Sheets

CARD GAME METHOD

RELATED APPLICATION

This application is a continuation-in-part of application Ser. No. 08/621,837 filed Mar. 26, 1996, now abandoned.

TECHNICAL FIELD

This invention concerns a novel method of playing a card game involving skill, probability and chance permitting customizing that is readily adapted for multiple player, casino style play as well as for interactive computer style play.

BACKGROUND OF THE INVENTION

Many different card games of chance and probabilities using cards comprise the basis for entertainment. It is not uncommon for certain types of card games to be adapted for casino style play involving wagering and exchange of tokens or money. Card-based games of this type include, for example, "21", Blackjack, Poker, and, in England, a game referred to as Brag.

In "21" or Blackjack the objective of the game for a player is to have the total card value exceed the dealer's hand but not exceed 21. Poker, on the other hand, because it is a winner-take-all game, is more complicated in that it involves a hierarchy of ranking hands. While variations exist, the hierarchy typically is based on ranking cards according to 1) the combination of cards dealt—three of a kind being better than a pair, and 2) the individual card value of the cards—ace (A) being the highest and two (2) being the lowest. In combination, the most desirable hand of cards contain all of the same type of card, e.g., all aces or all fives. The least desirable combination is a set of random, unique cards with low numbers, e.g., a two, a three, a five, and a six of different suits.

Certain card games lend themselves better to casino hosted play than others. Casino style games must be capable of reasonably quick play in order to retain interest by the players and to minimize time while maximizing turnover. Blackjack, for example, provides one such game. Blackjack or "21" are popular casino card games that have odds favoring the dealer and, therefore, are hosted by the house who supplies the dealer. Poker, on the other hand, is typically more complicated than Blackjack and is less precise. Also, the time involved to play one hand of poker is typically much more than that required for a hand of Blackjack. However, poker arguably lends itself to a higher level of excitement because of the greater degree of chance involved, the flexibility of its rules, and different styles and character of the players. Due to the added uncertainty, unbusiness-like high degree of chance, and winner-take-all outcome, poker is not a game in which a casino typically actively participates because such factors tend to reduce profitability to unacceptably low levels. Consequently, a casino will accommodate poker players by hosting the game in exchange for a small percentage of the wagers but will refrain from subjecting itself to the "excitement" of the game.

In casino style games, it is critical for a profit to be built into a card game assuming that the house does not commit errors. Thus, the profit is based on probabilities, not luck. On the other hand, ordinary players typically err by using poor judgment, taking unwarranted risks, or experiencing simple bad luck. Players will accept the dealer making a profit but there is a limit to the amount of acceptable profit taken in by the house/dealer. Although there is not a precise threshold tolerated by players, profit margins approximating 10% are generally considered to be too high for serious and experienced players.

Therefore, to combine the attractive attributes of casino style card games into a game would be desirable.

SUMMARY OF THE INVENTION

It is an object of this invention to provide a novel method for playing a card game that combines desirable attributes of the prior art games.

It is another object of this invention to provide a method for playing a card game that is readily adaptable for casino style wagering.

Still another object of the invention is to provide a new card game for multiple players that involves wagering.

A further object of the invention is to provide a novel game using a single deck of cards that combines attributes of "21" style games and poker.

Still a further object of the invention is to provide a card game permitting active participation of a dealer/host and in which probabilities dictate that the dealer/host will earn a profit.

It is another object of this invention to provide a game with a relatively fast turnover and which can be readily understood by most card players.

Yet another object of the invention is to provide some degree of flexibility of payout to players by the dealer to adjust the degree of profit earned by the dealer/host.

These and other objects are satisfied by a method of playing a card game adaptable to permit play by up to seven players and a dealer using a standard fifty-two card deck with an indicia bearing surface and an indicia concealing surface, comprising the steps of dealing to each player in sequence two cards indicia concealed and dealing two cards to the dealer, dealing an additional card indicia concealed to each player, dealing two additional cards to the dealer, permitting each player to discard one of that player's three cards and providing a substitute card, indicia concealed, to a player that discards a card, revealing the indicia of all of the dealer's cards to the players, selecting three of the four cards of each player and the dealer to establish the strongest hand of each, and comparing the dealer's hand to that of each player and designating the stronger of the two hands as the winner.

Still other objects of the invention are satisfied by a method of playing a card game by a plurality of players with a standard deck of cards, comprising the steps of:

a) providing a deck of cards to a dealer;

b) allowing the players to place a stake bet in the stake box before the dealer deals the cards;

c) dealing two cards face down to each player by the dealer;

d) dealing two cards to the dealer;

e) allowing each player the opportunity to double that player's stake;

f) dealing by the dealer an additional card face down to each player;

g) dealing two additional cards to the dealer;

h) allowing each player the choice of standing with that player's first three cards or discarding one of the three cards and having the dealer deal an additional card face down to that player;

i) revealing all of the dealer's cards to the players;

j) selecting three of the four cards of the dealer to establish the strongest hand;

k) comparing the dealer's hand to that of each player and designating the stronger of the two hands; and l) paying even-money to each player with a stronger hand than that of the dealer and collecting the bet of each player with a weaker hand than that of the dealer.

The invention herein, in essence, combines the most desirable features of known casino style card games in a manner to provide entertainment to the players and an adequate probability of return to the house or dealer. More particularly, elements of Blackjack and Poker predominate and the game correspondingly provides for options such as the opportunity for a player to double, surrender, purchase insurance, and obtain jackpots providing very substantial payout.

It is notable that a certain embodiment of the inventive method herein provides profit margins as high as about 11.5%. Other embodiments of the invention may yield profit margins of 9.75% or as little as 2.6% when the casino or bank grants bonuses/concessions to players based on certain circumstances. By providing select bonuses/concessions, the dealer profit margin can be reduced to a level sufficient to retain the interest of serious gamblers but one which retains an comfortable profit level for the host or casino.

"Wagering" as used herein is intended to encompass any discrete unit that can be exchanged including but not limited to money, chips, counters, tokens, pieces, points, etc.

"Hand" as used herein indicates a plurality of cards comprising a complement necessary for play of the game.

"Face-up" as used herein is intended to describe that the indicia bearing portion of the playing card required for play of the game is exposed to view.

"Face-down" as used herein is intended to describe that the indicia bearing portion of the playing card required for play of the game is concealed from view and must be turned over to view.

Given the following enabling description of the method and the drawings, the inventive card game herein should become evident to a person of ordinary skill in the art.

DETAILED DESCRIPTION OF THE EMBODIMENTS FOR CARRYING OUT THE INVENTION

Figure 1:
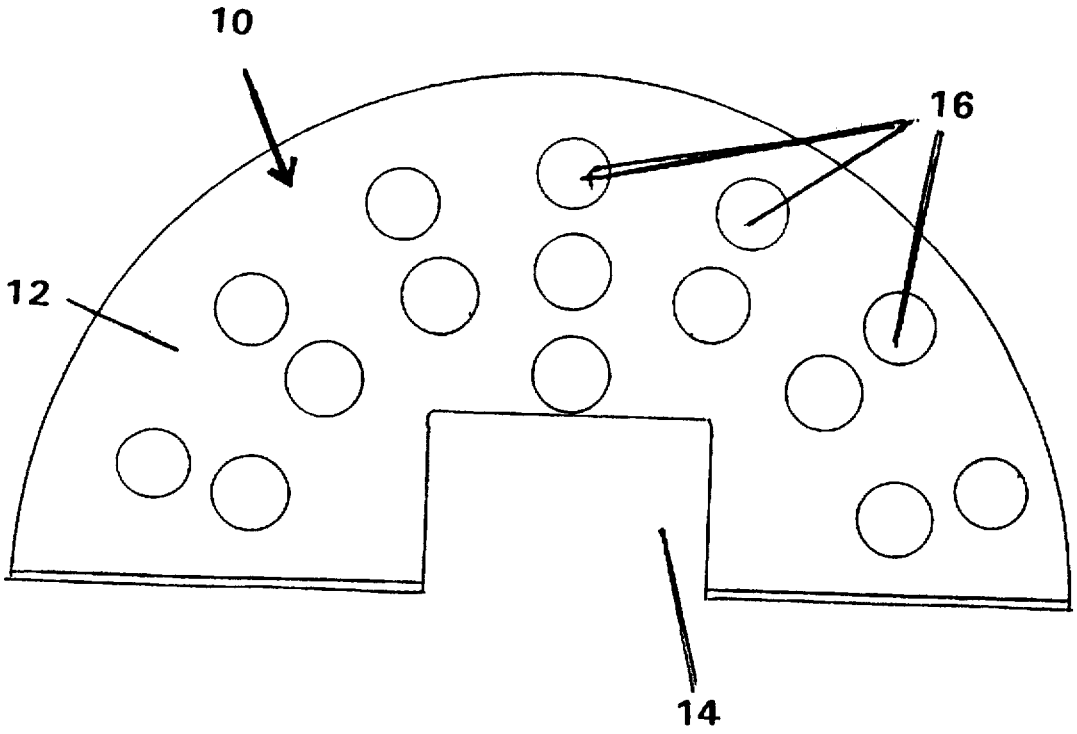
FIG. 1 is a diagrammatic representation of a table used in connection with the method of the invention.

FIG. 1 represents a table 10 that is configured for playing a card game according to the invention. The table 10 includes a generally planar, semicircular playing surface 12 with a cutout dealer's bay 14 formed centrally in the straight side. Seven players stations 16 defined by appropriate indicia are radially and substantially equidistantly located in a fan pattern from the dealer bay 14.

Figure 2:
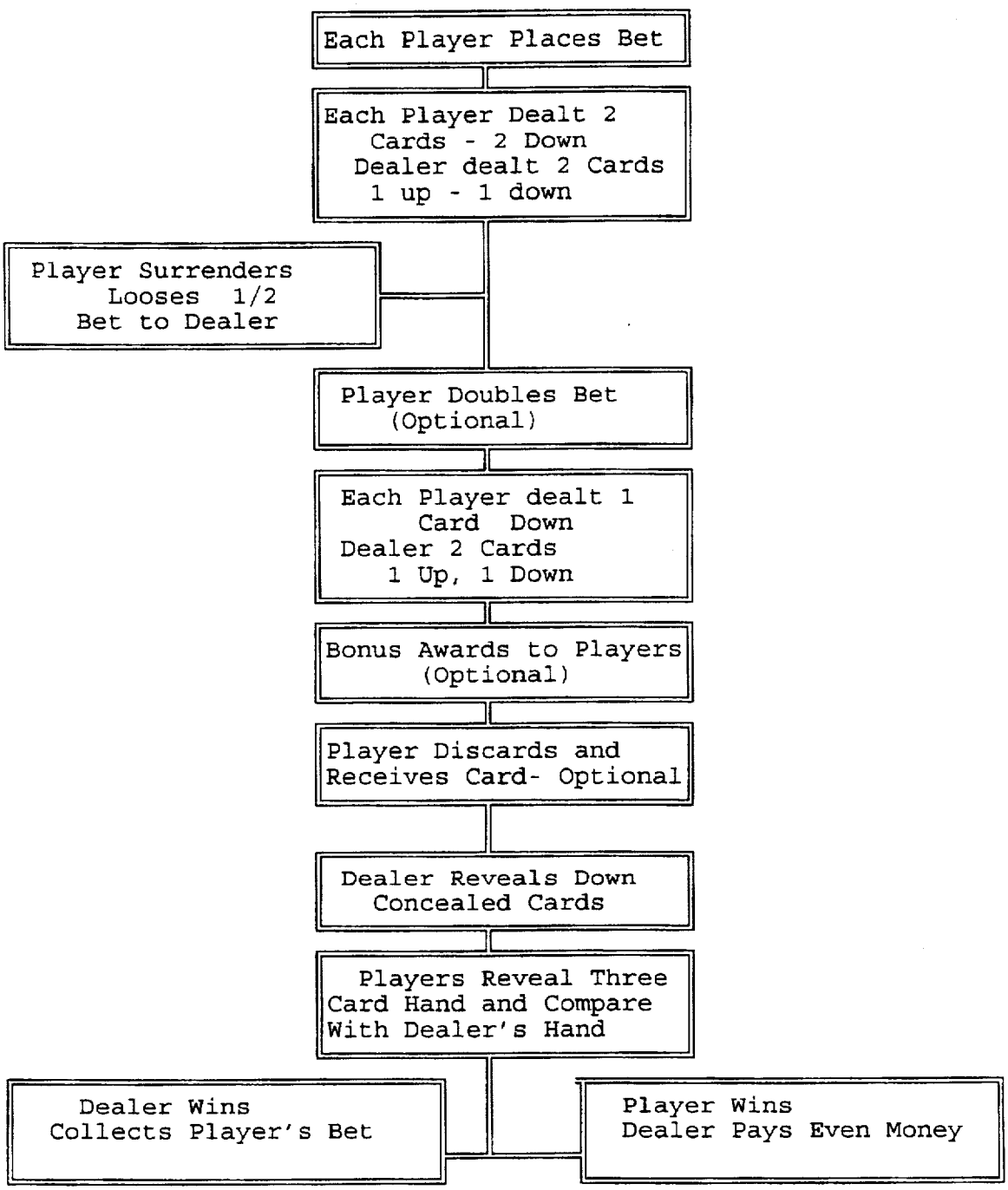
FIG. 2 is a flow chart illustrating steps of one embodiment of the method of the invention.

A first described method comprising the inventive game herein is represented by the flow chart in FIG. 2. The game is played preferably by six or seven players using one standard deck of playing cards comprising, i.e, four aces, four kings, four queens, etc.

Prior to dealing of the cards by the dealer, each player places a stake wager within the indicia (stake box) of that player's station. Once the stake wagers have been made, two cards are dealt to each player face down and one card dealt face up and one card dealt face down to the dealer.

Upon inspection of the dealt pair of cards, each player is provided with three options. First, the player may surrender the hand at a cost of one-half (½) the stake wager. The player may elect the status quo and elect to continue with the original wager. Finally, the player may double the original stake by placing the additional wager in the stake box; a move referred to in Blackjack as "doubling down".

After each player has made the foregoing election, each player is dealt one more card, face-down, and the dealer receives two (2) cards, one face-up and one face-down.

At this point, the dealer sequentially interrogates each player who is provided the option standing with the first three cards or electing to "discard"/'burn' one card. If the player elects to "discard", the fourth card dealt to the player remains face-down until the dealer's hand is finished. In this manner, no advantage is gained by the last players because those players are able to see the exposed extra cards. Furthermore, by concealing the fourth cards, extra excitement is generated.

The dealer's hand is finalized when the dealers face-down cards ("hole-cards") are turned over and the dealer selects three out of four cards to yield the strongest hand; the hand with the highest ranking.

The players then reveal their respective hands and, like the dealer, establish the strongest hand from three of the four cards according to the following poker type hierarchy ranked from highest to lowest:

Schedule/Rank of Winning Wagers

| Card Combination | Examples and Type |
|---|---|
| Straight Flush | Best Hand<br>3 cards in sequence of the same suit,<br>e.g. 8, 9, 10 of clubs |
| Three of a kind | 3 aces declining to 3 twos |
| Run | 3 cards in sequence of<br>any suit, e.g. 8, of hearts, 9 of spades,<br>and 10 of clubs |
| Flush | 3 cards of the same suit,<br>e.g. 3, 5 and queen of clubs |
| Pair | 2 cards of the same type,<br>2 aces declining to 2 twos |
| High Card | Ace high, two low |

Each player with a winning hand, a hand stronger than the dealer's hand, is paid an amount equal (even-money) to the wager in that player's stake box. Correspondingly, the wager in the stake box of a player with a hand that is weaker than the dealer's hand is collected by the dealer (the house). Additional payments by the dealer to individual players may be required at the conclusion of the hand according to the below-described bonus and jackpot concepts. If no payments are required then the dealer shuffles the deck and begins the next game.

In order to provide a reasonable profit margin to attract and retain serious players, it is suggested that the house employ bonus awards and even progressive jackpots to augment interest. The form of the particular type of bonus is flexible. One such bonus award format, as used, requires that the respective player forego the discard step and retain the original set of three cards to qualify. Bonus payments are awarded if the three original cards dealt to a player comprise three cards of the same kind, a straight flush (three numerically contiguous cards of the same suit), a run (three numerically contiguous cards in any suit), etc. The payment is made regardless of whether the player holds a winning hand. Preferably, the bonus amount will correspond to the probability of obtaining a particular grouping. The following chart details one preferred bonus payment format:

| Card Grouping | Bonus Paid Regardless of Winning Hand |
|---|---|
| 3 Aces and Dealer has fourth | 100 times stake wager |
| Straight Flush | 5 times stake wager |
| 3 of a kind | 4 times stake wager |
| Run | 1 stake wager |
| King High Flush or better | ½ stake wager |

Because the game herein is based on three original cards, the probabilities of obtaining particular hands or particular types of hands can be determined. In a conventional fifty two card deck there are 22,100 possible combinations of 3 cards. Of that substantial number there are 52 possible three of a kind combinations, 48 Straight Flush combinations, and 720 mixed suit run combinations. Where the above, multiplier-based, suggested bonus payments are awarded $(4\times52)+(5\times48)+(720\times1)=208+240+720=1168$, the probability of obtaining a bonus award is about 6.49% ($^{1168}/_{22,100}$). The award of bonus payments reduce the dealer's advantage from about 11.5% to a more acceptable 5.05%. This advantage may be reduced even further using additional devices to enhance the player's probabilities of winning. As indicated, the game provides for "doubling down". It may also incorporate "insurance" or an option for "surrendering" which is permitted a player only after the second cards are dealt. As in the game of Blackjack, if a player chooses to surrender, that player loses 50% of the stake wager.

Figure 3:
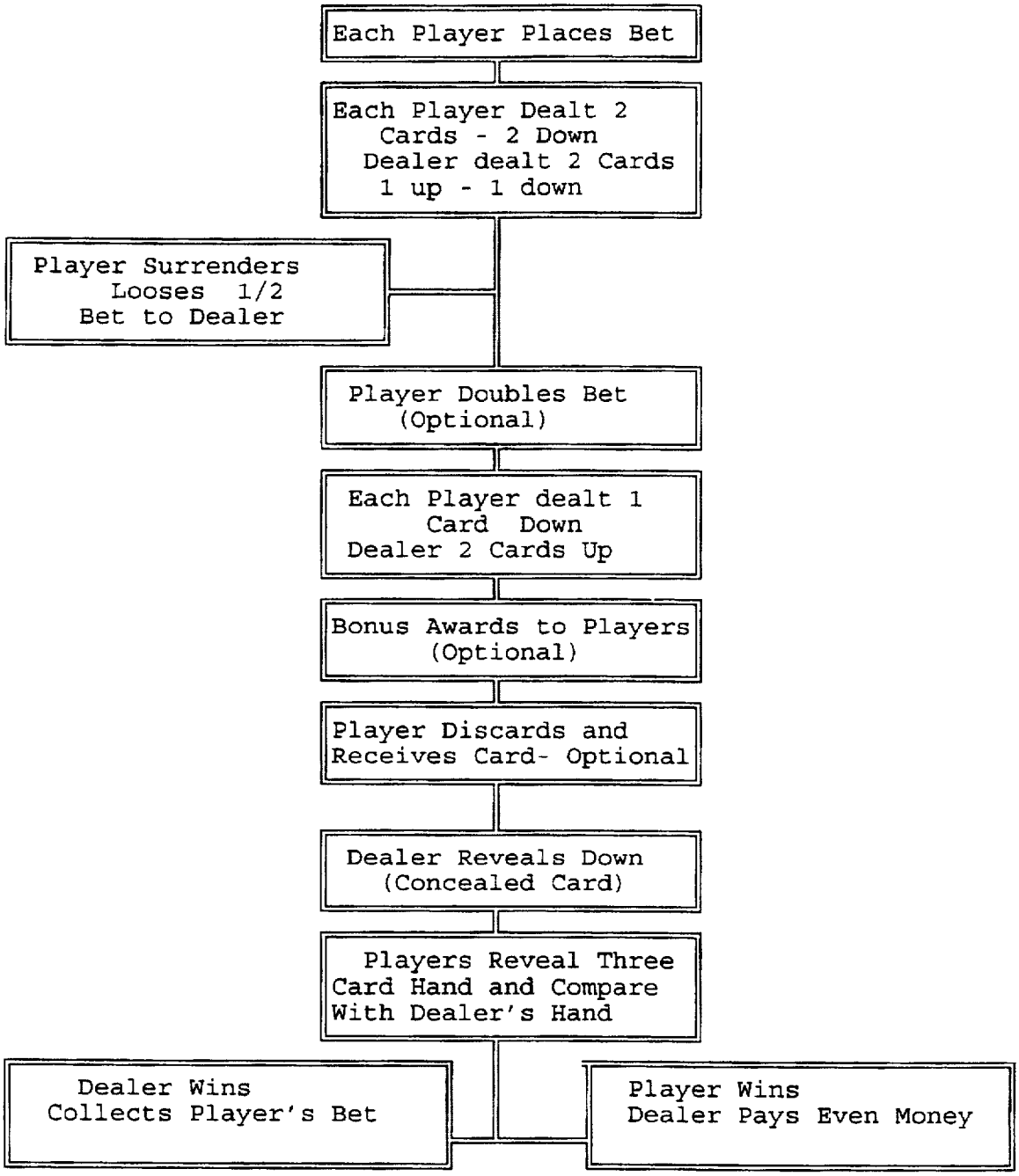
FIG. 3 is a flow chart illustrating steps of a second described embodiment of the method of the invention.

The second described embodiment of the inventive game herein is represented by the flow chart in FIG. 3. As before, the game is played preferably by six or seven players using one standard deck of playing cards. In short, this embodiment involves a process where the dealer exposes the indicia of three cards during the dealing process rather than exposing only two cards, as described above. The process of the second embodiment requires each player to place a stake wager for which that player will receive two cards face down from the dealer while the dealer deals himself one card face up and one card face down.

Upon inspection of the dealt pair of cards, each player is provided with three options. First, the player may surrender the hand at a cost of one-half (½) the stake wager. The player may elect the status quo and elect to continue with the original wager. Finally, the player may double the original stake by placing the additional wager in the stake box; a move referred to in Blackjack as "doubling down".

After each player has made the foregoing election, each player is dealt one more card, face-down, and the dealer receives two (2) cards, face-up. The dealer then sequentially interrogates each player about standing or discarding cards. Each player may stand with the first three cards dealt or electing to "discard"/'burn' one card. If the player elects to "discard", the fourth card dealt to the player remains face-down until the dealer's hand is finished. In this manner, no advantage is gained by the last players because those players are able to see the exposed extra cards. Furthermore, by concealing the fourth cards, extra excitement is generated.

The dealer's hand is finalized when the dealer's face-down card ("hole-card") is turned over and the dealer selects three out of four cards to yield the strongest hand; that with the highest ranking.

The players then reveal their respective hands and, like the dealer, establish the strongest hand from three of the four cards according to the hierarchy recited above in the table entitled Schedule/Rank of Winning Wagers. As in the case of the first embodiment, when a player has with a winning hand, he/she is paid an amount equal (even-money) to the wager in that player's stake box. Correspondingly, the wager in the stake box of a player with a hand that is weaker than the dealer's hand is collected by the dealer (the house). Additional payments by the dealer to individual players may be required at the conclusion of the hand according to the below-described bonus and jackpot concepts. If no payments are required then the dealer shuffles the deck and begins the next game.

Given the full description of the foregoing two and three dealer-card-exposed methods, it should be apparent that there are many other variations of the game. For example, the novel game of this invention may be achieved by modifying the above procedure so that only one of the dealer's cards has its indicia exposed to the players. The particular sequence of exposing dealer cards may be varied (the first two cards being dealt up and last two down, the first up and last up, etc. Likewise, the sequence of revealing the players cards both to the dealer and to other players at the table can be rearranged.

In testing the game, it was determined that a one dealer card up method tends to overly favor the dealer. Therefore, if such a choice is made, it is important to maintain a high level of interest in the game by serious gamblers. Thus, higher and different bonuses can be developed. For example, the game can include progressive or fixed Jackpots. In the case of jackpots, each player may make a separate, small collateral wager at the time of the stake wager, e.g., one dollar. The player would be awarded a fixed amount, e.g., $5,000 should that player originally draw three of a kind (thus, automatically entitling the player to a bonus) followed by a matching fourth card (drawn for jackpot purposes only). When the fourth card makes four of a kind, the fixed jackpot sum is awarded. The jackpot may also be ranked to provide different awards for different card values and because the probabilities of drawing four Aces is so small (221183:1), the entire progressive Jackpot (with a minimum of $5,000) could be awarded.

The inventive method of this game also is capable of adapting to computer play either as an interactive game hosted by a server with remote players where stakes are electronically monitored or as an automatic game with one active player/dealer and the remaining players computer controlled. Such a game could be packaged as a single piece or as part of a larger package of software for loading onto a personal computer.

INDUSTRIAL APPLICABILITY

The invention herein provides a novel casino style card game allowing for wagering that provides amusement and entertainment for players and provides a reasonable profit margin for the dealer/house. The card game provides a unique sequence and method of play that can be adapted for conventional table style play or incorporated into software for stand-alone computer play or interactive play at a plurality of sites.

Given the foregoing, variations and modifications to the invention should now be apparent to a person having ordinary skill in the art. These variations and modifications are intended to fall within the scope and spirit of the invention as defined by the following claims.

What is claimed is:

1. A method of playing a card game adaptable to permit play by up to seven players and a dealer using a standard fifty-two card deck with an indicia bearing surface and an indicia concealing surface, comprising the steps of dealing to each player in sequence two cards indicia concealed and dealing two cards to the dealer, dealing an additional card indicia concealed to each player, dealing two additional cards to the dealer, permitting each player to discard one of that player's three cards and providing a substitute card, indicia concealed, to a player that discards a card, revealing the indicia of all of the dealer's cards to the players, selecting three of the four cards of each player and the dealer to establish the strongest hand of each, and comparing the dealer's hand to that of each player and designating the stronger of the two hands as the winner.

2. The card game method of claim 1 where the two cards dealt to the dealer when dealing the one card face down to each of the players, are dealt with their indicia exposed.

3. The method of playing a game according to claim 2 further comprising the step of providing a bonus payment to a player if the first three cards dealt are any of a three of the same kind of card, a flush, a straight flush, a king high flush, or a run.

4. The method of playing a game according to claim 3 including the step of paying the bonus regardless of whether the player ultimately wins the hand.

5. The card game method of claim 1 where one of the additional cards is dealt to the dealer after dealing the one card face down to each of the players so that its indicia is exposed.

6. The method of playing a game according to claim 5 paying a bonus of a multiple of the original stake for either a three of the same kind of card or a straight flush.

7. The method of playing a game according to claim 1 further comprising the step of providing a progressive jackpot.

8. The method of playing a game according to claim 1 further comprising the step of providing each player with the opportunity to place a supplemental bet in a discrete progressive jackpot before the cards are dealt at the beginning of a jackpot and paying a selected amount to a player making such a bet if the player is dealt three of the same kind of card and draws a fourth card that matches the three of a kind to make four of the same kind of card.

9. The method of claim 1 including the step of providing each player the opportunity to double down after having been dealt the first two cards.

10. The method of claim 1 including the step of providing each player the opportunity to purchase insurance before the cards are dealt.

11. A method of playing a card game by a plurality of players with a standard deck of cards, comprising the steps of:

a) providing a deck of cards to a dealer;

b) allowing the players to place a stake bet in the stake box before the dealer deals the cards;

c) dealing two cards face down to each player by the dealer;

d) dealing two cards to the dealer;

e) allowing each player the opportunity to double that player's stake;

f) dealing by the dealer an additional card face down to each player;

g) dealing two additional cards to the dealer;

h) allowing each player the choice of standing with that player's first three cards or discarding one of the three cards and having the dealer deal an additional card face down to that player;

i) revealing all of the dealer's cards to the players;

j) selecting three of the four cards of the dealer to establish the strongest hand;

k) comparing the dealer's hand to that of each player and designating the stronger of the two hands; and l) paying even-money to each player with a stronger hand than that of the dealer and collecting the bet of each player with a weaker hand than that of the dealer.

12. The method of playing a game according to claim 11 where only one of the additional cards dealt to the dealer has its indica exposed to the players.

13. The method of playing a game according to claim 11 where neither of the additional cards dealt to the dealer has its indica exposed to the players.

14. The method of playing a game according to claim 11 where both of the additional cards dealt to the dealer have their indica exposed to the players.

15. The method of playing a game according to claim 11 further comprising the step of providing a bonus payment to a player if the first three cards dealt are any of a three of the same kind of card, a flush, a straight flush, a king high flush, or a run.

16. The method of playing a game according to claim 15 including the step of paying the bonus regardless of whether the player ultimately wins the hand.

17. The method of playing a game according to claim 16 paying a bonus of up to one hundred times the original stake bet.

18. The method of playing a game according to claim 17 comprinsg the step of paying a bonus of ½ times the original stake wager for a flush, four (4) times the original stake wager for a three of the same kind of card, and five (5) times the original stake wager for a straight flush.

19. The method of playing a game according to claim 17 paying a one time the stake if the player has a run in any suit.

20. The method of playing a game according to claim 16 further comprising the step of providing each player with the opportunity to place a supplemental bet in a discrete progressive jackpot before the cards are dealt at the beginning of a hand and paying a selected amount to a player making such a bet if the player is dealt three of the same kind of card and draws a fourth card that matches the three of a kind to make four of the same kind of card.

21. The method of claim 20 including the steps of ranking the hands of the players according to the following hierarchy; three of the same kind of cards, a straight flush, a run comprising three cards of any suit in sequence, a flush comprising three cards of the same suit, a pair of the same kind of card, and the high card.

22. The method of claim 16 including the steps of ranking the hands of the players according to the following hierarchy; a straight flush, three of the same kind of cards, a run comprising three cards of any suit in sequence, a flush comprising three cards of the same suit, a pair of the same kind of card, and the high card.

23. The method of playing a game according to claim 17 further comprising the step of providing a progressive jackpot.

24. The method of playing a game according to claim 17 further comprising the step of providing each player with the opportunity to place a supplemental bet in a discrete progressive jackpot before the cards are dealt at the beginning of a hand and paying a selected amount to a player making such a bet if the player is dealt three of the same kind of card and draws a fourth card that matches the three of a kind to make four of the same kind of card.

25. The method of playing a game according to claim 24 where the discrete amount of the bet is one dollar, the jackpot has a minimum value of $5,000 and the selected amount is either the entire jackpot for four Aces or a payment of $5,000 for any other four of the same kind of card.

26. The method of claim 11 including the steps of ranking the hands of the players according to the following hierarchy; a straight flush, three of the same kind of cards, a run comprising three cards of any suit in sequence, a flush comprising three cards of the same suit, a pair of the same kind of card, and the high card.

27. The method of claim 11 including the step of allowing a player to surrender after the second card is dealt upon payment of ½ the original stake bet.

28. The method of claim 11 including the step of providing each player the opportunity to double down after having been dealt the first two cards.

29. The method of claim 11 including the step of providing each player the opportunity to purchase insurance before the cards are dealt.

30. A method of playing a card game by a plurality of players with a standard deck of cards, comprising the steps of:

a) providing a deck of cards to a dealer;

b) allowing the players to place a stake bet in the stake box before the dealer deals the cards;

c) dealing two cards to each player by the dealer;

d) dealing to the dealer one card face up and one card face down by the dealer;

e) allowing each player the opportunity to double that player's stake;

f) dealing by the dealer an additional card to each player;

g) dealing to the dealer two cards face up;

h) allowing each player the choice of standing with that player's first three cards or discarding one of the three cards and having the dealer deal an additional card face down to that player;

i) turning over the card of the dealer's which is face down to reveal that card to the players;

j) selecting three of the four cards of the dealer to establish the strongest hand;

k) comparing the dealer's hand to that of each player and designating the stronger of the two hands; and l) paying even-money to each player with a stronger hand than that of the dealer and collecting the bet of each player with a weaker hand than that of the dealer.

31. A method of playing a card game adaptable to permit play by up to seven players and a dealer using a standard fifty-two card deck with an indicia bearing surface and an indicia concealing surface, comprising the steps of:

a) dealing to each player in sequence two cards indicia concealed and to the dealer one card indicia exposed and one card indicia concealed;

b) dealing an additional card indicia concealed to each player;

c) dealing two cards indicia concealed to the dealer;

d) permitting each player to discard one of that player's three cards and providing a substitute card, indicia concealed, to a player that discards a card;

e) revealing the indicia of the dealer's cards which have been concealed;

f) selecting three of the four cards of each player and the dealer to establish the strongest hand of each; and g) comparing the dealer's hand to that of each player and designating the stronger of the two hands as the winner.

* * * * *